US007455484B2

(12) United States Patent
Bauschulte et al.

(10) Patent No.: US 7,455,484 B2
(45) **Date of Patent: *Nov. 25, 2008**

(54) CUTTING OR BREAKING TOOL AS WELL AS CUTTING INSERT FOR THE LATTER

(75) Inventors: Heinrich Bauschulte, Eiterfeld-Leimbach (DE); Marco Schumann, Eiterfeld-Soisdorf (DE); Wolfgang Wald, Rasdorf (DE); Martina Stuckardt, Haunetal (DE); Ernst Heiderich, Hohenroda (DE); Reinhold Walter, Rossdorf (DE)

(73) Assignee: Barat Carbide Holding GmbH, Burghaun (DE)

( * ) Notice: Subject to any disclaimer, the term of this patent is extended or adjusted under 35 U.S.C. 154(b) by 1480 days.

This patent is subject to a terminal disclaimer.

(21) Appl. No.: 10/004,154

(22) Filed: Oct. 30, 2001

(65) Prior Publication Data

US 2002/0164215 A1 Nov. 7, 2002

Related U.S. Application Data

(62) Division of application No. 09/453,132, filed on Dec. 2, 1999, now Pat. No. 6,354,771.

(30) Foreign Application Priority Data

Dec. 12, 1998 (DE) ..... 198 57 451

(51) Int. Cl.
*B23B 27/22* (2006.01)
*B23B 27/16* (2006.01)

(52) U.S. Cl. ..... 407/114; 407/61; 299/111; 175/427

(58) Field of Classification Search ..... 407/61, 407/114, 118, 33, 30; 299/111, 110, 101, 299/113

See application file for complete search history.

(56) References Cited

U.S. PATENT DOCUMENTS

| | | | | | |
|---|---|---|---|---|---|
| 5,209,612 | A * | 5/1993 | Kish | 407/54 |
| 5,324,098 | A * | 6/1994 | Massa et al. | 299/111 |
| 5,429,459 | A * | 7/1995 | Palm | 409/66 |
| 5,551,760 | A * | 9/1996 | Sollami | 299/105 |
| 6,019,434 | A * | 2/2000 | Emmerich | 299/111 |
| 6,164,877 | A * | 12/2000 | Kamata et al. | 407/61 |
| 6,354,771 | B1 * | 3/2002 | Bauschulte et al. | 407/114 |
| 6,846,135 | B2 * | 1/2005 | Kuroda et al. | 407/53 |

* cited by examiner

*Primary Examiner*—Willmon Fridie
(74) *Attorney, Agent, or Firm*—Gudrun E. Huckett Draudt

(57) ABSTRACT

A cutting insert for a cutting or breaking tool, which can be mounted in a tool holder that can be rotated about its longitudinal axis, especially for a lathe chisel, has an essentially conical tip, a transition region and a foot for connecting to a tool body, wherein the transition region has several spatial areas which are distributed over its periphery and adjoin one another forming spatial and cutting edges.

21 Claims, 1 Drawing Sheet

Fig.1b
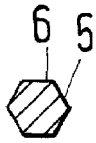
Fig.2b
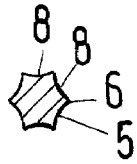
Fig.1a
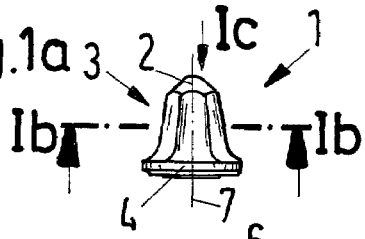
Fig.2a
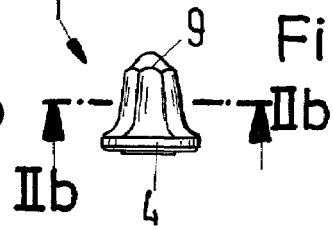
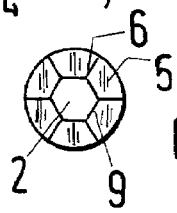
Fig.1c
Fig.3
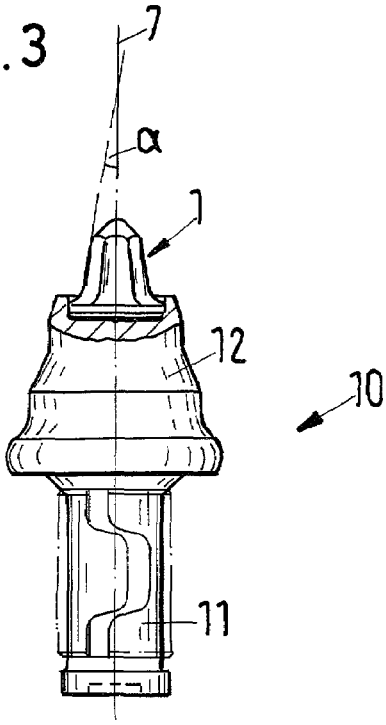
Fig.4a
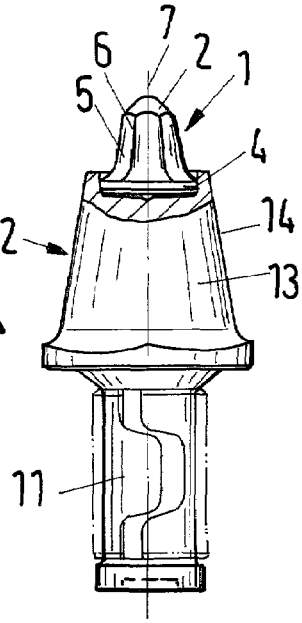
Fig.4b
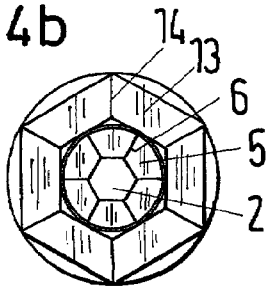

CUTTING OR BREAKING TOOL AS WELL AS CUTTING INSERT FOR THE LATTER

CROSS-REFERENCE TO RELATED APPLICATION

This application is a continuation of application Ser. No. 09/453,132, filed Dec. 2, 1999 now U.S. Pat. No. 6,354,771.

BACKGROUND

The present invention relates to a cutting insert for a cutting or breaking tool, which can be mounted in a tool holder that can be rotated about a longitudinal axis, and especially to a lathe chisel as well as to such a cutting or breaking tool itself.

Such tools are rotatably mounted in tool holders, which are usually fastened to a surface of a rotating roller. In the case of tools known in practice, heads of tool bodies and intermediate regions of cutting inserts are conical and constructed with a round cross section. A different hard alloy insert, described in the WO 94/13932, has a ribbed intermediate region, as a result of which an improved spatial behavior is to be attained, since the regions between the ribs serve to carry away material that has been cut off or broken off. However, because the material to be processed generally contains tar, the spaces between the ribs clog up quickly, so that the improved spatial behavior exists for only a short time.

SUMMARY OF THE INVENTION

It is therefore an object of the present invention to provide a generic cutting insert as well as a generic cutting or breaking tool, which has improved and durable spatial as well as cutting and breaking properties.

Pursuant to the present invention, this objective is accomplished by a cutting insert with a substantially conical tip, a transition region connected to the substantially conical tip having spatial areas distributed over a periphery of the transition region and adjoining one another to form cutting edges, and a foot connected to the transition region for connecting with the cutting or breaking tool.

The present invention further provides a cutting and breaking tool, especially a lathe chisel, for mounting in a tool holder so that it can be rotated about a longitudinal axis, with a head and a tool body having a shaft and a cutting insert as described above.

Due to the spatial areas, which are disposed distributed over the periphery of the transition region of the cutting insert and which, in comparison with a cutting insert of circular cross section, are disposed in secant fashion, free regions are formed between the edges of these spatial areas adjoining one another. As the tool is rotated, waste material is ejected from these free regions and transported out of a working region without sticking or clogging. Since the edges are constructed by spatial areas as cutting edges, they have an additional peeling action during rotation of the tool. This peeling action reinforces the cutting action of a tip of the cutting insert, so that a depth of penetration and a service life of the tool as a whole are improved and, as a result, the lathe chisel remains sharp longer.

Further advantages and details arise out of further features and embodiments of the present invention, which are explained in the following and shown in the drawings.

BRIEF DESCRIPTION OF THE DRAWINGS

FIG. 1*a* shows a side view of an inventive cutting insert,

FIG. 1*b* shows a section along the line Ib-Ib in FIG. 1*a*,

FIG. 1*c* shows a view from the direction Ic in FIG. 1*a*,

FIG. 2*a* shows the object of FIG. 1*a* in a different embodiment,

FIG. 2*b* shows a section along the line IIb-IIb in FIG. 2*a*,

FIG. 3 shows a side view of an inventive tool with cutting insert,

FIG. 4*a* shows the object of FIG. 3 in a different embodiment and

FIG. 4*b* shows a view from the direction IVb in FIG. 4*a*.

DETAILED DESCRIPTION

Referring to FIGS. 1*a* to 1*c*, a cutting insert 1 has a conical tip 2, a transition region 3 and a foot 4. A peripheral area of the transition region 3 is formed by six spatial areas 5, which adjoin one another forming spatial and cutting edges 6. The spatial areas 5 are inclined towards a longitudinal axis 7 of the cutting inserts 1 in such a manner that they enclose an acute angle $\alpha$ with the latter which preferably is less than 45°. As a result, the cutting insert 1 has an essentially conical shape, which has a hexagonal cross section in the case of the embodiment shown. The conical shape of the cutting insert 1, achieved by the inclination of the spatial surfaces 5, provides it with good stability. With regard to reducing the wear of the cutting insert 1, it is advantageous to have the angle $\alpha$ as small as possible, in order to settle as much material as possible close to the conical tip 2. As shown, the spatial areas 5 are rounded as they change over into the foot 4. This is also advantageous with respect to stability.

Referring to FIG. 2, the spatial areas 5 can also be curved concavely, as a result of which the spatial areas 5 and cutting edges 6 can be constructed sharper and larger free spaces 8 for accommodating and removing waste material are formed. For both embodiments, the spatial areas 5 and cutting edges 6 act as scoops for removing material and, furthermore, provide a resistance to the material, which leads to a uniform rotation and therefore to a uniform wear of the tool 1. In order to improve penetration behavior further, the edges 9, obtained between the tip 2 and the spatial areas 5, can also be constructed as sharp cutting edges.

Referring to FIG. 3, a lathe chisel is shown with a conventional tool body 10 and the cutting insert 1. The tool body 10 has an essentially cylindrical shaft 11 for rotatably mounting it in a tool holder, and a head 12, with which the cutting insert 1 is connected preferably by means of solder.

Referring to FIG. 4, a different embodiment of the tool, for which the head 12 of the tool body 10, like the cutting insert 1, also has spatial areas 13, which adjoin one another forming edges 14, distributed over its periphery. Due to this shape of the head 12 of the tool body 10, the cutting, waste removal and rotational behavior can be improved further particularly when the tool body 10 penetrates deeply into the material being processed. This effect is reinforced further if, as can be seen especially in FIG. 4*b*, the edges 14 of the head 12 are disposed offset to the spatial and cutting edges 6 of the transition region of the cutting insert 1. By these means, the waste material is caused to move helically, which favors its removal, and a uniform rotation of the tool body 10 is ensured in that an edge 6, 14, which causes the tool to rotate, is present over the peripheral surface of the tool body 10 in each region either at the top at the cutting insert 1 or lower at the head 12 of the tool body 10.

The invention claimed is:

1. A cutting insert having a longitudinal axis comprising:

a substantially conical tip;

a transition region connected to the substantially conical tip having a periphery, an even number plurality of spatial areas and a plurality of cutting edges between the spatial areas;

a foot connected to the transition region; and the plurality of spatial areas being curved concavely in a direction from the foot to the conical tip;

wherein the plurality of spatial areas are distributed over the periphery of the transition region and adjoin one another to form the plurality of cutting edges.

2. The cutting insert of claim 1, wherein the plurality of spatial areas are also curved concavely in a circumferential direction of the cutting insert.

3. The cutting insert of claim 2, wherein the plurality of spatial areas are inclined to enclose an acute angle with the longitudinal axis at a portion thereof adjacent the conical tip.

4. The cutting insert of claim 1, wherein the plurality of spatial areas are inclined to enclose an acute angle with the longitudinal axis at a portion thereof adjacent the conical tip.

5. The cutting insert of claim 1, wherein the plurality of spatial areas are flat in a circumferential direction of the cutting insert.

6. The cutting insert of claim 5, wherein the plurality of spatial areas are inclined to enclose an acute angle with the longitudinal axis at a portion thereof adjacent the conical tip.

7. A cutting insert having a longitudinal axis comprising:

a substantially conical tip;

a transition region connected to the substantially conical tip having a periphery, an even number plurality of spatial areas and a plurality of cutting edges between the spatial areas;

a foot connected to the transition region; and the plurality of spatial areas being curved concavely in a circumferential direction of the cutting insert;

wherein the plurality of spatial areas are distributed over the periphery of the transition region and adjoin one another to form the plurality of cutting edges.

8. The cutting insert of claim 7, wherein the plurality of spatial areas are inclined to enclose an acute angle with the longitudinal axis at a portion thereof adjacent the conical tip.

9. A lathe chisel having a longitudinal axis comprising:

ahead;

a tool body having a shaft cooperating with the head and configured for rotatable mounting; and a cutting insert including:

a substantially conical tip;

a transition region connected to the substantially conical tip having a periphery, an even number plurality of spatial areas and a plurality of cutting edges between the spatial areas;

a foot connected to the transition region and fixedly connected with the head; and the plurality of spatial areas being curved concavely in a direction from the foot to the conical tip;

wherein the plurality of spatial areas are distributed over the periphery of the transition region and adjoin one another to form the plurality of cutting edges.

10. The lathe chisel of claim 9, wherein the head has a plurality of head edges and a plurality of head areas distributed over a periphery of the head, said plurality of head areas adjoin one another to form the plurality of head edges.

11. The lathe chisel of claim 10, wherein the plurality of spatial areas and the plurality of cutting edges are offset to the plurality of head edges.

12. The lathe chisel of claim 9, wherein the plurality of spatial areas are also curved concavely in a circumferential direction of the cutting insert.

13. The lathe chisel of claim 12, wherein the plurality of spatial areas are inclined to enclose an acute angle with the longitudinal axis at a portion thereof adjacent the conical tip.

14. The lathe chisel of claim 9, wherein the plurality of spatial areas are inclined to enclose an acute angle with the longitudinal axis at a portion thereof adjacent the conical tip.

15. The lathe chisel of claim 9, wherein the plurality of spatial areas are flat in a circumferential direction of the cutting insert.

16. A lathe chisel having a longitudinal axis comprising:

ahead;

a tool body having a shaft cooperating with the head and configured for rotatable mounting; and a cutting insert including:

a substantially conical tip;

a transition region connected to the substantially conical tip having a periphery, an even number plurality of spatial areas and a plurality of cutting edges between the spatial areas;

a foot connected to the transition region and fixedly connected with the head; and the plurality of spatial areas being curved concavely in a circumferential direction of the cutting insert;

wherein the plurality of spatial areas are distributed over the periphery of the transition region and adjoin one another to form the plurality of cutting edges.

17. The lathe chisel of claim 16, wherein the head has a plurality of head edges and a plurality of head areas distributed over a periphery of the head, said plurality of head areas adjoin one another to form the plurality of head edges.

18. The lathe chisel of claim 17, wherein the plurality of spatial areas and the plurality of cutting edges are offset to the plurality of head edges.

19. The lathe chisel of claim 16, wherein the plurality of spatial areas are also curved concavely in a circumferential direction of the cutting insert.

20. The lathe chisel of claim 16, wherein the plurality of spatial areas are inclined to enclose an acute angle with the longitudinal axis at a portion thereof adjacent the conical tip.

21. The lathe chisel of claim 16, wherein the plurality of spatial areas are inclined to enclose an acute angle with the longitudinal axis at a portion thereof adjacent the conical tip.

* * * * *